United States Patent [19]

Fiocco

[11] Patent Number: 4,669,637

[45] Date of Patent: Jun. 2, 1987

[54] PERFUME DISPENSING CONTAINER

[76] Inventor: Maria G. Fiocco, via G. Bruno 26, Verona, Italy

[21] Appl. No.: 616,880

[22] Filed: Jun. 4, 1984

[30] Foreign Application Priority Data

Jun. 13, 1983 [IT] Italy ..... 63330/83[U]

[51] Int. Cl.[4] ..... B67D 3/00

[52] U.S. Cl. ..... 222/187; 401/206

[58] Field of Search ..... 222/187; 401/206, 205, 401/292; 220/354, 353

[56] References Cited

U.S. PATENT DOCUMENTS

| | | | |
|---|---|---|---|
| 2,458,027 | 1/1949 | Quist | 401/206 |
| 3,589,824 | 6/1971 | Clarcona et al. | 401/206 |
| 4,043,681 | 8/1977 | Funahashi | 401/206 |

FOREIGN PATENT DOCUMENTS

| | | | |
|---|---|---|---|
| 848111 | 4/1969 | Canada | 401/206 |
| 929953 | 9/1960 | United Kingdom | 401/206 |

*Primary Examiner*—Joseph J. Rolla
*Assistant Examiner*—Kenneth Noland
*Attorney, Agent, or Firm*—Guido Modiano; Albert Josif

[57] ABSTRACT

The present invention relates to a perfume dispensing container, which comprises a bottle arranged to contain perfume to be dispensed. The bottle has an outlet opening and is housed in a case having a dispensing pad arranged to be put into communication with the said outlet opening, thereby absorbing perfume therefrom. The container also comprises a seating and holding device and a protection cap removably positionable in the case over and around the pad.

3 Claims, 10 Drawing Figures

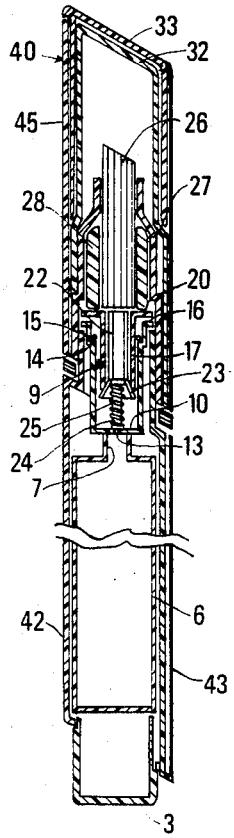
FIG. 8
FIG. 7
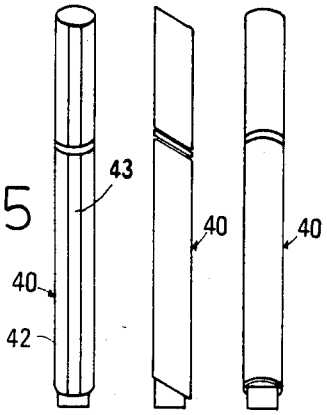
FIG. 5
FIG. 6
FIG. 9
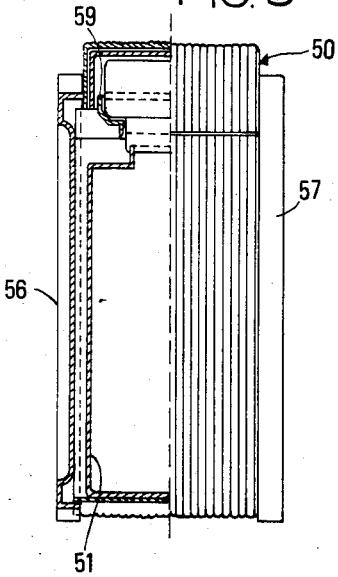
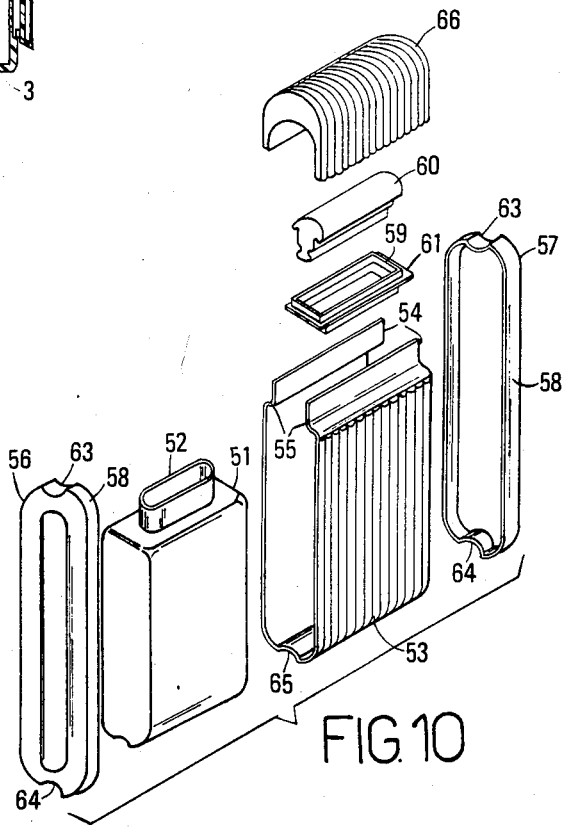
FIG. 10

PERFUME DISPENSING CONTAINER

BACKGROUND OF THE INVENTION

This invention relates to a perfume dispensing container.

Two systems are conventionally used for storing and applying perfume, i.e. containers provided with screw caps and containers provided with an end dispensing sprayer or atomizer. Perfume containers or bottles having a screw cap are sometimes difficult to open and close, liable for dispensing too much, and thus for wasting, perfume and inevitably exposed to the risk of being inadvertently overturned once the cap has been removed. With containers equipped with atomizers, on the other hand, substantial amounts of perfume are dispersed, and thus wasted, in the air and in any case, the perfume jet produced by sprayer must be suitably oriented. The spraying action is often obtained by pressurizing the perfume, which besides involving additional costs for manufacturing facilities may adversely affect the quality of the perfume or impair the possibility of miniaturizing the perfume bottles.

SUMMARY OF THE INVENTION

It is a primary object of this invention to eliminate, or substantially reduce, the aforesaid drawbacks affecting prior known systems.

Another object of this invention is to provide a perfume dispensing container which makes it possible to properly apply perfume to specifically restricted areas with no waste.

It is a further object of the invention to provide a perfume dispensing container which is simple to product and thus can be manufactured at low costs.

These and other objects, such as will be apparent hereinafter, are achieved according to the invention by a dispensing container for liquid cosmetic products, in particular perfume, comprising a bottle arranged to contain liquid product to be dispensed and having an outlet opening, a case accommodating said bottle, a dispensing pad disposed on said case and arranged to be put into communication with the outlet opening of the bottle, thereby absorbing liquid product therefrom, pad seating and holding means, and a pad protection cap removably positionable on said case over and around said pad.

BRIEF DESCRIPTION OF THE DRAWINGS

Further aspects and advantages of this invention will be more clearly apparent from the following detailed description of some preferred, though not exclusive, embodiments thereof, to be read in conjunction with the accompanying drawings, in which:

FIG. 5 is a front elevation view of a perfume dispensing container, as fashioned to resemble a pen;

FIG. 6 is a side view of the perfume dispensing container of FIG. 5;

FIG. 7 is a rear view of the perfume dispensing container of FIG. 5;

FIG. 8 is a longitudinal sectional view, on an enlarged scale, of the perfume dispensing container of FIGS. 5 to 7;

FIG. 9 is a view showing, half in elevation and half in section, a perfume dispensing container, as fashioned to resemble an electric razor; and FIG. 10 is an exploded perpective view of the dispensing container of FIG. 9.

DESCRIPTION OF THE PREFERRED EMBODIMENTS

Figure 4:
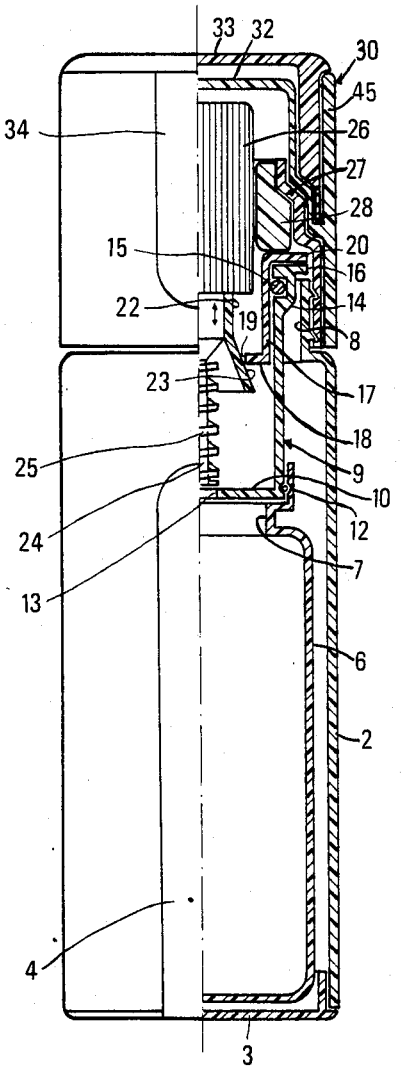
FIG. 4 is a cross-sectional view taken along the line IV—IV of FIG. 1.
Figure 3:
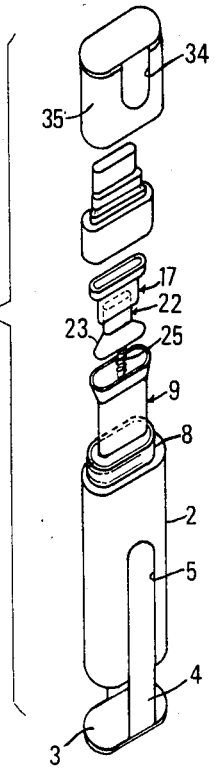
FIG. 3 shows an exploded perspective view of the perfume dispensing container of FIGS. 1 and 2.
Figure 2:
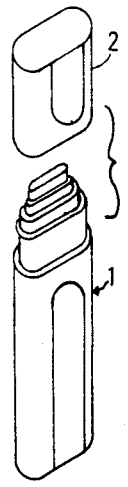
FIG. 2 is a perspective view of the perfume dispensing container of FIG. 1 with its cover removed.
Figure 1:
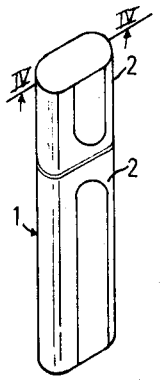
FIG. 1 is a perspective view of a perfume dispensing container, as fashioned to resemble a cigar lighter.

With reference to FIGS. 1 to 4 of the drawings, an embodiment of the perfume dispensing container is generally indicated at 1 and is fashioned to resemble a cigar lighter, and comprises a flattened box-like case 2 closed at the bottom by a cover 3 which may be attached to, or removably positioned on, the case. Advantageously, the cover 3 may be provided with two opposed side lugs 4 which extend lengthwise to the case and are designed to engage with a respective slot 5 formed in the side wall of the case 2. A bottle 6 (FIG. 4), having an access opening 7 and containing liquid perfume, may be placed inside the case 2 by removing the cover 3.

At the remote end from the end engaged by the cover 3, the case 2 has a neck portion 8 accomodating a valve seat 9 therein. The valve seat 9 abuts, at its bottom 10, against the opening 7 of the bottle 6, where it is sealingly seated by means of a liquid-tight sealing means such as a gasket 12. The bottom 10 of the valve seat 9 is formed with a through hole 13 which puts the valve seat 9 in communication with the bottle 6. At its other end, the valve seat 9 has an expansion 14 in which a seat for a gasket 15 and a flanged peripheral rim 16 abutting against the free edge of the case neck 8 are formed. The seat 9 accomodates a guide element 17 having its bottom 18 apertured at 19 and an outer flange formation 20 which abuts against the flanged rim 16.

A valve element 22 is movably mounted through the aperture 19 and has a conical portion 23 arranged to shut the aperture 19. At its end facing the bottom 10 of the valve seat 9, the valve element 22 has a tang 24 which projects from the conical portion 23 and supports a coil spring 25 abutting against the bottom 10. At its opposed end the valve element 22 is engaged by a pad 26 which is made of a suitably absorbent material, such as a spongy material or a material comprising one or more fiber bundles, and is slidably mounted in a hood 27 and partly in the guide element 17. The pad 26 extends from the hood 27 and, in use, may be pushed against the valve element 22, so that while overcoming the bias of the spring 25, the valve element 22 will partly uncover the aperture 19 through which, if the dispensing container is held upside down or inclined, perfume from the bottle or perfume reservoir 6 can flow so as to be absorbed by the pad 26.

The perfume absorbed in the pad 26 can be controllably and safely applied to a desired specific area, such as a relatively small portion of the user's skin, by rubbing the pad 26 on it.

The hood 27 is secured, e.g. by snap fit, on the exterior of the neck 18 of the case, and holds a sealing and slide gasket 28 located between the flange 20 and pad 26.

A cap 29 can be removably slid over the hood 27 and comprises a lateral portion 30 integral with an inner liner 32 and a top lid 33 for insertion between the portion 30 and liner 32. Advantageously, the lateral portion 30 may be formed with two diametrically opposed slots 34, whereat the lid 33 may be expanded such as at 35 to fit in the slots 34.

The operation of and way of using the dispensing container 1 should be apparent from the foregoing description, and a further description thereof is deemed to be unnecessary.

If a removable bottom 3 is provided, a perfume dispensing container 1 can be rechargeable by replacing an emptied bottle 6 with another one filled with perfume.

The embodiment illustrated in FIGS. 5 to 8 provides a perfume dispensing container 40 having the same structural components as that shown in FIGS. 1 to 4, and thus like or similar components have been designated by the same reference numerals and a detailed description thereof is omitted. The perfume dispensing container 40 is fashioned to resemble a pen, and is especially suitable for miniaturization. The outer case 42 has a bottom 3 of reduced diameter and removably attachable to the case 42 for insertion of the bottle or reservoir 6 in it. A longitudinal facing 43 is provided along the case 42 and cap 45 which, additionally to enhancing the dispenser appearrance, is effective to prevent the perfume dispensing container 40 from rolling away when laid onto a smooth surface.

The embodiment shown in FIGS. 9 and 10 provides a perfume dispensing container 50 fashioned to resemble an electric razor. It comprises a basin or bottle 51 having a protruding access/dispensing mouth 52. The basing 51 is adapted to fit in a case including a U-shaped component 53 which has shaped ends each formed with a longitudinally extending end portion 54 and an intermediate transversely extending section 55 which delimits an inner shoulder. The case also comprises two lateral sides 56 and 57 having a peripheral rim 58 for snap-action engagement with the component 53 and a support frame 59 arranged to be inserted between the two sections 54 and partly under the shoulder 55. The frame 59 is adapted to accommodate a pad 60 which is forced through the frame to abut against the free edge portion of the mouth 52 of the basin 51 within the case. The frame 59 may have its interior variously shaped, while a peripheral outer molding 61 runs all around it and is adapted to engage with the shoulder 55 along two opposite sides of the frame and to act as an abutment for an upper depression 63 in the removable sides 56, 57 of the case. A lower depression 64 in the sides 56, 57 is adapted to engage with a respective inner bulge 65 of the component 53. A protection lid can be placed over and around the pad 59.

By means of a perfume dispensing container 50 perfume can be conveniently applied to selected and relatively small parts by rubbing the pad 26 or 60, or a specific area with no waste of perfume.

The materials employed in the construction of the dispensing container according to the invention may vary, although plastics materials are presently preferred.

I claim:

1. A dispensing container for liquid cosmetic products, such as perfume, comprising a case arranged to accomodate a bottle containing a liquid to be dispensed and having a removable cover at one end for insertion of the bottle therein and a neck portion at its other end;

a valve body secured to the inner surface of the said neck portion and including a valve seat extending from the said neck portion inside the case and being arranged to sealingly abut against the bottle neck, and a guide element arranged inside the valve seat;

a valve element slidably mounted within the guide element and having a projecting extension, a spring mounted on said projecting extension and arranged to abut against the said valve body;

a hood member secured to, and projecting beyond, the outer surface of the said neck portion and comprising an inner annular slide gasket seated therein;

a pad member projecting from the hood member and slidingly mounted in the said annular slide gasket so as to abut against the said valve element; and a top cap removably insertable onto the said hood member and having a side portion integral with an inner liner portion and a top lid portion inserted between and secured to the said side and liner portions.

2. A dispensing container as claimed in claim 1, wherein the said guide element has an end flange formation arranged to abut against the valve seat and to provide a resting surface for the said pad member.

3. A dispensing container as claimed in claim 1, wherein the said removable cover for the case and the said top cap comprise each an end covering wall provided with two opposite side lugs extending lengthwise to the case or the cover body, and a pair of opposite slots along the case or cover body which are arranged to locate a respective side lug.

* * * * *